US011846306B2

(12) United States Patent
Takakuwa et al.

(10) Patent No.: US 11,846,306 B2
(45) Date of Patent: Dec. 19, 2023

(54) AIR CYLINDER, HEAD COVER, AND ROD COVER

(71) Applicant: SMC CORPORATION, Chiyoda-ku (JP)

(72) Inventors: Youji Takakuwa, Kitakatsushika-gun (JP); Akihiro Kazama, Moriya (JP); Hiroyuki Asahara, Tsukuba (JP); Kengo Monden, Ushiku (JP)

(73) Assignee: SMC CORPORATION, Chiyoda-ku (JP)

( * ) Notice: Subject to any disclaimer, the term of this patent is extended or adjusted under 35 U.S.C. 154(b) by 6 days.

(21) Appl. No.: 17/640,754

(22) PCT Filed: Aug. 3, 2020

(86) PCT No.: PCT/JP2020/029602

§ 371 (c)(1),
(2) Date: Mar. 4, 2022

(87) PCT Pub. No.: WO2021/044783

PCT Pub. Date: Mar. 11, 2021

(65) Prior Publication Data

US 2022/0333622 A1 Oct. 20, 2022

(30) Foreign Application Priority Data

Sep. 6, 2019 (JP) ..... 2019-162910

(51) Int. Cl.
*F15B 15/14* (2006.01)
*F15B 15/20* (2006.01)
(Continued)

(52) U.S. Cl.
CPC ..... *F15B 15/1433* (2013.01); *F15B 11/06* (2013.01); *F15B 15/204* (2013.01);
(Continued)

(58) Field of Classification Search
CPC .... F15B 15/1433; F15B 15/204; F15B 15/22; F15B 2211/30505; F15B 2211/3052;
(Continued)

(56) References Cited

U.S. PATENT DOCUMENTS 5,349,151 A * 9/1994 Eisbrenner ..... F15B 11/022 91/461
6,848,641 B2 * 2/2005 Lohmann ..... F15B 11/003 242/129
(Continued)

FOREIGN PATENT DOCUMENTS

JP 4-48404 U 4/1992
JP 5-106605 A 4/1993
(Continued)

OTHER PUBLICATIONS

International Search Report dated Oct. 13, 2020 in PCT/JP2020/029602 filed on Aug. 3, 2020 (citing references AS, therein, 2 pages).

*Primary Examiner* — Dustin T Nguyen
(74) *Attorney, Agent, or Firm* — Oblon, McClelland, Maier & Neustadt, L.L.P.

(57) ABSTRACT

An air cylinder in which a flow rate controller is built in, has a head cover and a rod cover. A pilot air adjustment unit guides exhaust air to a switch valve of the flow rate controller as pilot air, and the switch valve is switched by an increase in the pressure of the pilot air.

7 Claims, 6 Drawing Sheets

(51) Int. Cl.
*F15B 15/22* (2006.01)
*F15B 11/06* (2006.01)

(52) U.S. Cl.
CPC ..... *F15B 15/22* (2013.01); *F15B 2211/3052* (2013.01); *F15B 2211/30505* (2013.01); *F15B 2211/40515* (2013.01); *F15B 2211/40576* (2013.01); *F15B 2211/40584* (2013.01); *F15B 2211/40592* (2013.01); *F15B 2211/411* (2013.01); *F15B 2211/41527* (2013.01); *F15B 2211/41581* (2013.01); *F15B 2211/428* (2013.01); *F15B 2211/455* (2013.01); *F15B 2211/46* (2013.01); *F15B 2211/6355* (2013.01); *F15B 2211/67* (2013.01); *F15B 2211/75* (2013.01); *F15B 2211/8855* (2013.01)

(58) Field of Classification Search
CPC .. F15B 2211/40515; F15B 2211/40576; F15B 2211/40584; F15B 2211/40592; F15B 2211/411; F15B 2211/41527; F15B 2211/41581; F15B 2211/428; F15B 2211/455; F15B 2211/46; F15B 2211/6355; F15B 2211/67; F15B 2211/75; F15B 2211/8855
See application file for complete search history.

(56) References Cited

U.S. PATENT DOCUMENTS

| | | | | |
|---|---|---|---|---|
| 8,578,837 | B1 * | 11/2013 | Burhoe | F15B 15/22 91/461 |
| 10,760,318 | B2 * | 9/2020 | Fortmann | E05F 15/50 |

FOREIGN PATENT DOCUMENTS

| | | | |
|---|---|---|---|
| JP | 2000-199503 | A | 7/2000 |
| JP | 5578502 | B2 | 8/2014 |
| JP | 2016-161055 | A | 9/2016 |
| JP | 2016-205431 | A | 12/2016 |

* cited by examiner

AIR CYLINDER, HEAD COVER, AND ROD COVER

TECHNICAL FIELD

The present invention relates to an air cylinder, a head cover, and a rod cover.

BACKGROUND ART

Conventionally, a shock absorber has been used in which a cushioning material made of a soft resin such as rubber or urethane or the like, or an oil damper or the like is attached to an end part of an air cylinder, to thereby cushion an impact at a stroke end. However, such a shock absorber that mechanically mitigates shocks in the cylinder is limited in terms of the number of operations it can perform, and requires regular maintenance.

In order to resolve such incompatibility, in JP 5578502 B2, a speed controller (flow rate controller) is disclosed in which, by throttling the exhaust air that is discharged from the air cylinder in the vicinity of a stroke end, an operating speed of the air cylinder is reduced.

SUMMARY OF THE INVENTION

In such a conventional flow rate controller, pilot air is gradually discharged through a throttle valve, and when the pilot pressure falls below a predetermined value, a switching valve performs a switching operation to throttle the exhaust air. However, it has been determined that when the pressure acting on the throttle valve falls below a predetermined pressure, the flow of the pilot air passing through the throttle valve may rapidly decrease, and the timing at which the switching operation occurs becomes unstable.

Further, such a conventional flow rate controller is an external component that is connected to ports of the air cylinder, which increases the number of component parts of the drive device of the air cylinder, and the device configuration of the drive device becomes complex. Further, a space for installation of the flow rate controller is required externally of the air cylinder.

The present invention has the object of providing an air cylinder, a head cover, and a rod cover, which enable a timing at which a switching operation occurs to be stabilized, and the device configuration of a drive device to be simplified.

One aspect of the present invention is characterized by an air cylinder comprising a cylinder tube in which a cylinder chamber is formed, a head cover configured to close one end of the cylinder tube, a rod cover configured to close another end of the cylinder tube, a piston configured to slide in the cylinder chamber, a piston rod having one end connected to the piston, a port provided in each of the head cover and the rod cover, and a flow rate controller incorporated in at least one of the head cover or the rod cover, wherein the flow rate controller includes a main flow path communicating with the port, an auxiliary flow path disposed in parallel with the main flow path, and including a first throttle valve configured to throttle a flow rate of air to a flow rate less than that in the main flow path, a cylinder flow path communicating with the cylinder chamber, a switching valve connected to the main flow path, the auxiliary flow path, and the cylinder flow path, and configured to be switched between a first position in which the cylinder flow path is allowed to communicate with the main flow path, and a second position in which the cylinder flow path is allowed to communicate with the auxiliary flow path, and a pilot air adjustment part configured to guide a portion of exhaust air in the cylinder flow path to the switching valve as pilot air, and wherein the pilot air adjustment part includes a second throttle valve configured to regulate an inflowing speed at which the pilot air flows into the switching valve, and the switching valve is switched from the first position to the second position due to a rise in a pressure of the pilot air.

Another aspect of the present invention is characterized by a head cover for an air cylinder having the aforementioned configuration, wherein the above-described flow rate controller is incorporated in the head cover.

Another aspect of the present invention is characterized by a rod cover for an air cylinder having the aforementioned configuration, wherein the above-described flow rate controller is incorporated in the rod cover.

In accordance with the air cylinder, the head cover, and the rod cover according to the above-described aspects, the timing at which the switching operation occurs can be stabilized, and the device configuration of the drive device can be simplified.

DESCRIPTION OF THE INVENTION

Hereinafter, a preferred embodiment of the present invention will be presented and described in detail below with reference to the accompanying drawings.

First Embodiment

Figure 1A:
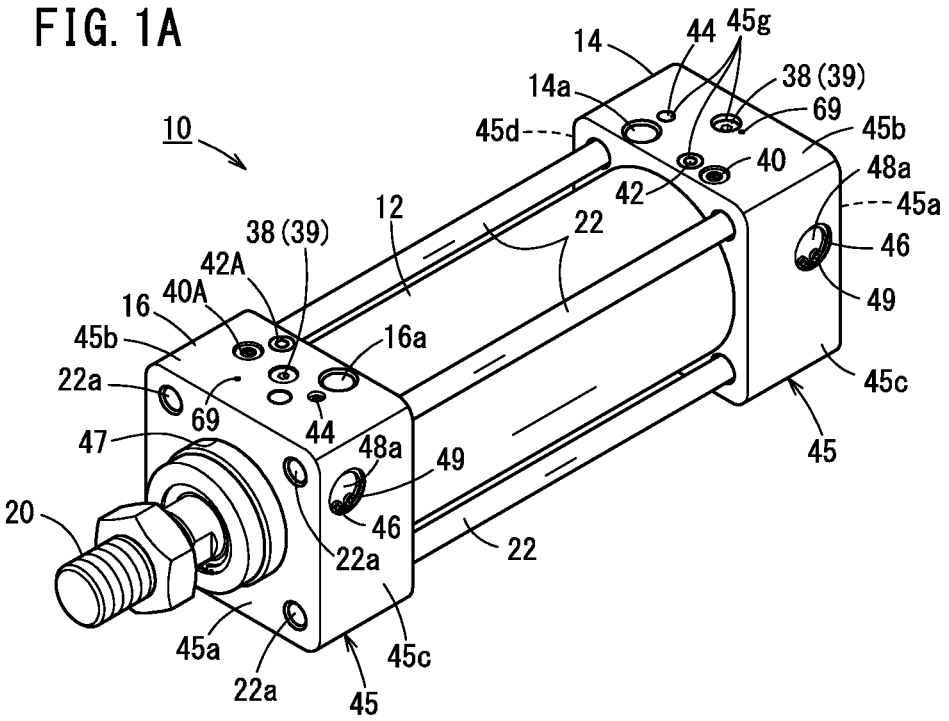
FIG. 1A is a perspective view on a rod cover side of an air cylinder according to the embodiment.
Figure 1B:
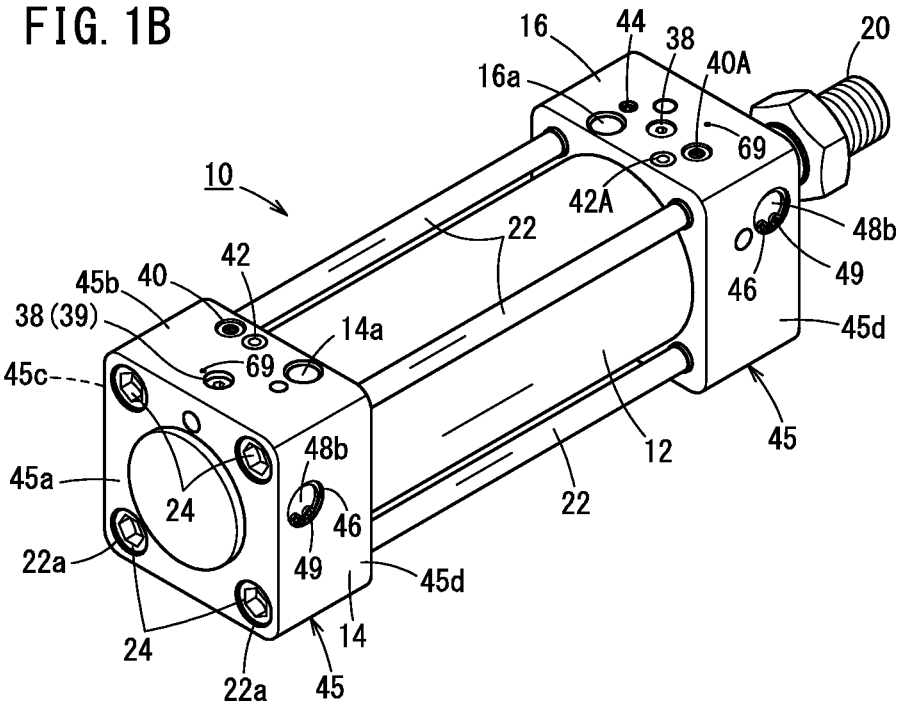
FIG. 1B is a perspective view on a head cover side of the air cylinder shown in FIG. 1A.

As shown in FIGS. 1A and 1B, an air cylinder 10 is a double acting cylinder that is used in an automated equipment line or the like. The air cylinder 10 is equipped with a cylindrical cylinder tube 12, a head cover 14 that seals a head side end part of the cylinder tube 12, and a rod cover 16 that seals a rod side end part of the cylinder tube 12. The cylinder tube 12, the head cover 14, and the rod cover 16 are connected in an axial direction by a plurality of connecting rods 22 and connecting bolts 24. A head side port 14*a* is formed in the head cover 14, and a rod side port 16*a* is formed in the rod cover 16. A piston rod 20 projects and extends out from the rod cover 16.

Figure 2:
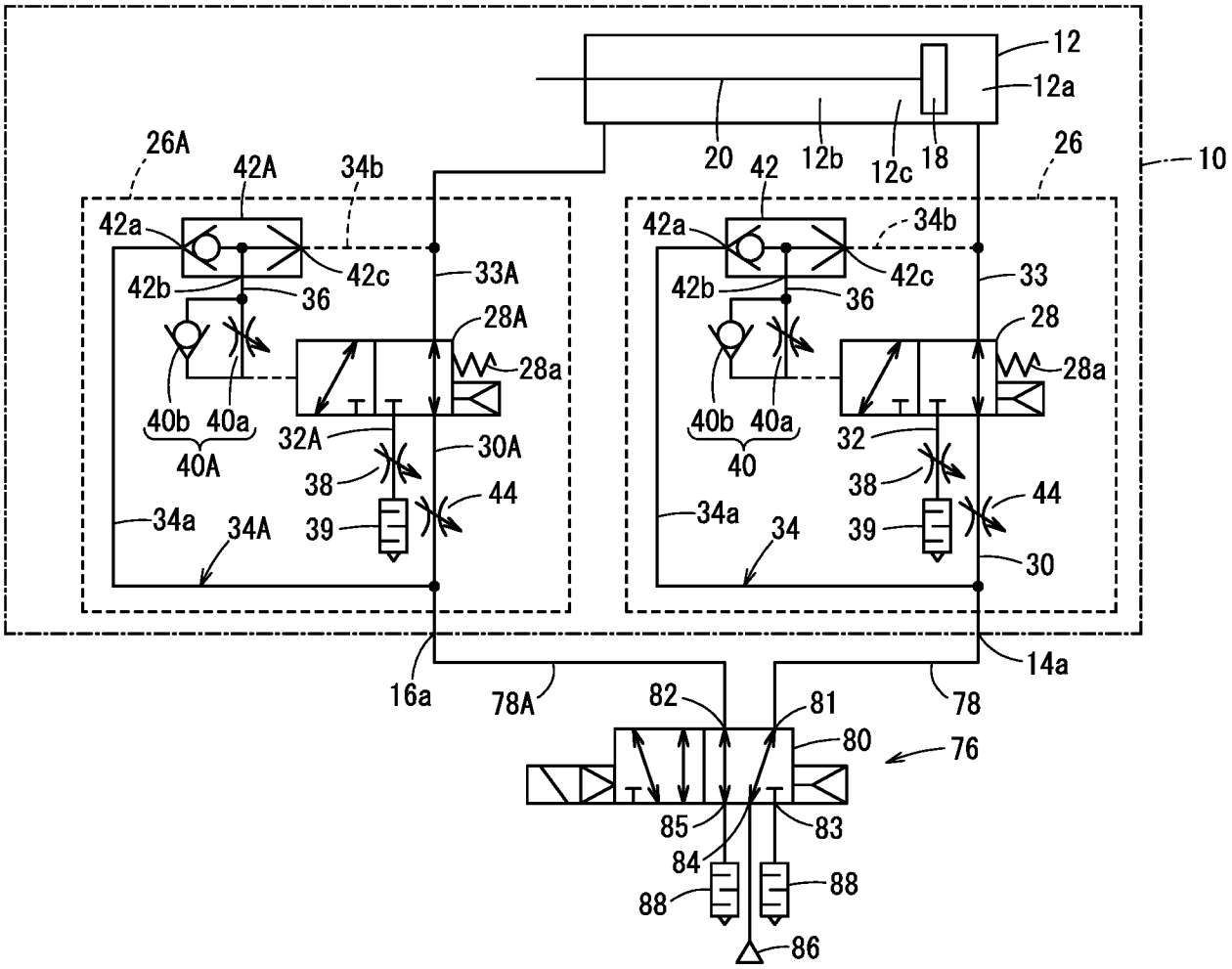
FIG. 2 is a fluid circuit diagram of the air cylinder shown in FIG. 1A, and a drive device thereof.

In the interior of the cylinder tube 12, as shown in FIG. 2, there are provided a piston 18 that slides in a cylinder chamber 12*c*, and a piston rod 20 connected to the piston 18. A head side flow rate controller 26 is connected to a head side pressure chamber 12*a* on the head side of the piston 18, and a rod side flow rate controller 26A is connected to a rod side pressure chamber 12*b* on the rod side of the piston 18. The head side flow rate controller 26 is incorporated in the head cover 14, and the head side port 14*a* is connected to the head side pressure chamber 12*a* via the flow rate controller 26. Further, the rod side flow rate controller 26A is incorporated in the rod cover 16, and the rod side port 16*a* is connected to the rod side pressure chamber 12*b* via the flow rate controller 26A.

The head side flow rate controller 26 includes a main flow path 30 communicating with the head side port 14*a*, an auxiliary flow path 32 disposed in parallel with the main flow path 30, a cylinder flow path 33 communicating with the head side pressure chamber 12*a*, and a bypass flow path 34 connecting the main flow path 30 and the cylinder flow path 33. A first throttle valve 38 that variably regulates the flow rate of the exhaust air, and an exhaust port 39 through which the exhaust air that has passed through the first throttle valve 38 is discharged, are provided in the auxiliary flow path 32. A third throttle valve 44 that variably regulates the flow rate of the exhaust air is provided in the main flow path 30. By regulating the flow rate of the exhaust air, the first throttle valve 38 and the third throttle valve 44 limit an operating speed of the piston 18. The first throttle valve 38 is configured to throttle the flow rate of the exhaust air more strongly than the third throttle valve 44.

A switching valve 28 is disposed between the main flow path 30 and the auxiliary flow path 32, and the cylinder flow path 33. The switching valve 28 is a three-way valve operated by the pilot air, and is connected to the main flow path 30, the auxiliary flow path 32, and the cylinder flow path 33. At a first position shown in the drawings, the switching valve 28 connects the main flow path 30 to the cylinder flow path 33, and by switching to a second position, connects the cylinder flow path 33 to the auxiliary flow path 32. The switching valve 28 is biased toward the first position by an elastic force of a return spring 28*a*, and switches to the second position when the pressure of the pilot air increases.

One end of the bypass flow path 34 is connected to the main flow path 30 in the vicinity of the head side port 14*a*, whereas the other end thereof is connected to the cylinder flow path 33, to connect the main flow path 30 and the cylinder flow path 33 while bypassing the third throttle valve 44 and the switching valve 28. The bypass flow path 34 is provided with a shuttle valve 42, which includes a first inlet 42*a*, a second inlet 42*b*, and an outlet 42*c*. A first portion 34*a* of the bypass flow path 34 is connected to the first inlet 42*a*, a pilot air flow path 36 is connected to the second inlet 42*b*, and a second portion 34*b* of the bypass flow path 34 is connected to the outlet 42*c* of the shuttle valve 42. The first portion 34*a* of the bypass flow path 34 is a portion communicating with the main flow path 30, and the second portion 34*b* is a portion communicating with the cylinder flow path 33. The pilot air flow path 36 is connected to the switching valve 28 via a pilot air adjustment part 40.

When the pressure in the main flow path 30 becomes higher than the pressure in the cylinder flow path 33, the shuttle valve 42 closes the second inlet 42*b*, allows the first inlet 42*a* and the outlet 42*c* to communicate with each other, and causes the bypass flow path 34 to open, to thereby guide the high pressure air of the main flow path 30 to the cylinder flow path 33. Further, when the pressure in the cylinder flow path 33 becomes higher than the pressure in the main flow path 30, the shuttle valve 42 closes the first inlet 42*a* and allows the second inlet 42*b* and the outlet 42*c* to communicate with each other, to thereby guide the exhaust air of the cylinder flow path 33 to the switching valve 28 as pilot air.

The pilot air adjustment part 40 is disposed in the pilot air flow path 36, and is equipped with a second throttle valve 40*a*, and a check valve 40*b* which is connected in parallel with the second throttle valve 40*a*. A downstream side of the second throttle valve 40*a* and the check valve 40*b* is connected to the side of a later-described piston member 54 of the switching valve 28. The second throttle valve 40*a* supplies the pilot air to the switching valve 28 at a predetermined flow rate, and causes the switching valve 28 to be displaced to the second position at a predetermined timing. The check valve 40*b* is connected in a direction that allows passage of the pilot air flowing from the switching valve 28 toward the shuttle valve 42, and when the switching valve 28 is returned to the first position, the pilot air in the switching valve 28 is rapidly discharged.

The head side flow rate controller 26 that is incorporated in the head cover 14 is formed with the circuit configuration as described above. Further, since the rod side flow rate controller 26A that is incorporated in the rod cover 16 is formed with substantially the same circuit configuration as the head side flow rate controller 26, the same constituent elements as those of the head side flow rate controller 26 are designated by the same reference numerals, and detailed description thereof is omitted. However, with respect to the switching valve 28, the main flow path 30, the auxiliary flow path 32, the cylinder flow path 33, the bypass flow path 34, the pilot air adjustment part 40, and the shuttle valve 42 of the rod side flow rate controller 26A, the letter A has been appended to each of such reference numerals in order to distinguish them.

Next, a description will be given of a drive device 76 that drives the air cylinder 10. The air cylinder 10 is driven by the drive device 76, which is connected to the head side port 14*a* and the rod side port 16*a*. The drive device 76 is equipped with an operation switching valve 80, a high pressure air supply source 86 for supplying the high pressure air, and exhaust ports 88 for discharging the exhaust air that is discharged from the air cylinder 10. The operation switching valve 80 is a 5-port valve that electrically switches a connection destination of the high pressure air, and includes first through fifth ports 81 to 85. The first port 81 is connected via a pipe 78 to the head side port 14*a*, and the second port 82 is connected via a pipe 78A to the rod side port 16*a*. The third port 83 and the fifth port 85 are connected to the exhaust ports 88, and the fourth port 84 is connected to the high pressure air supply source 86.

At a first position shown in FIG. 2, the operation switching valve 80 allows the first port 81 and the fourth port 84 to communicate with each other, and allows the second port 82 and the fifth port 85 to communicate with each other. In this manner, the operation switching valve 80 allows the high pressure air supply source 86 to communicate with the head side port 14*a*, and allows the rod side port 16*a* to communicate with the exhaust port 88, thereby carrying out an operating stroke.

Further, at a second position, the operation switching valve 80 allows the first port 81 and the third port 83 to communicate with each other, and allows the second port 82 and the fourth port 84 to communicate with each other. In this manner, the operation switching valve 80 connects the high pressure air supply source 86 to the rod side port 16*a*, and connects the exhaust port 88 to the head side port 14*a*, thereby carrying out a return stroke.

The circuit configuration of the air cylinder 10 and the drive device 76 thereof is configured in the manner described above. Hereinafter, a description will be given concerning a specific configuration of the head cover 14 in which the flow rate controller 26 is incorporated, and the rod cover 16.

As shown in FIGS. 1A and 1B, the head cover 14 includes a box-shaped main body portion 45 having a rectangular end surface 45*a*, which is perpendicular to the axial direction. A plurality of valve holes 45*g* are provided together with the head side port 14*a* on an upper surface 45*b* of the main body portion 45. The first throttle valve 38 (the exhaust port 39), the pilot air adjustment part 40, the shuttle valve 42, and the third throttle valve 44 are disposed in these valve holes 45*g*. Connecting holes 22*a* for mounting of the connecting rods 22 and the connecting bolts 24 are formed at the four corners of the end surface 45*a* of the main body portion 45.

As shown in FIGS. 1A and 1B, a switching valve installation hole 46 in order for the switching valve 28 to be formed therein opens in a first side surface 45*c* and a second side surface 45*d* of the main body portion 45. The switching valve installation hole 46 is provided in a portion closer to the upper surface 45*b* than the center of the main body portion 45, and as shown in FIG. 4B, the switching valve installation hole 46 is formed to penetrate from the first side surface 45*c* side to the second side surface 45*d* side.

Figure 3A:
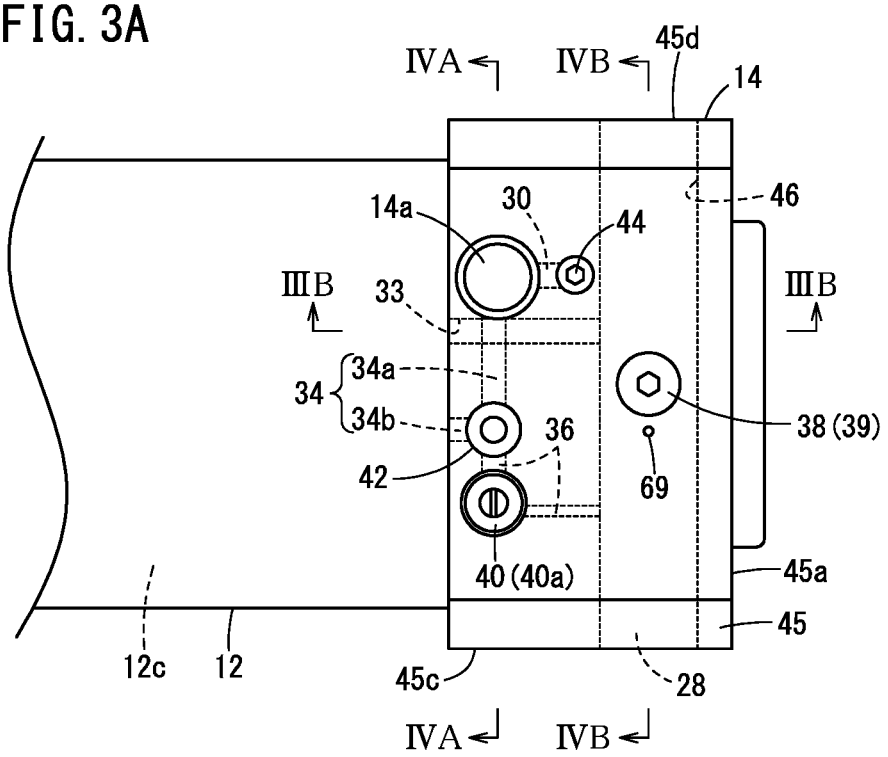
FIG. 3A is a plan view showing an arrangement of a first throttle valve, a second throttle valve, a third throttle valve, and ports of the head cover shown in FIG. 1A.
Figure 3B:
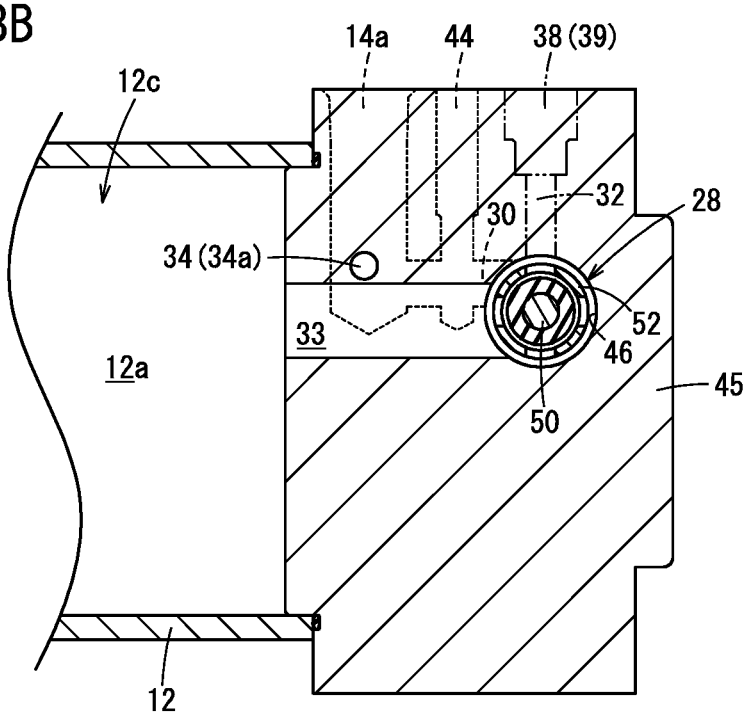
FIG. 3B is a cross-sectional view taken along line IIIB-IIIB of FIG. 3A.

As shown in FIGS. 3A and 3B, the main flow path 30 is formed so as to extend from the head side port 14*a* toward the switching valve installation hole 46, and the third throttle valve 44 is disposed midway along the main flow path 30. The first throttle valve 38 and the exhaust port 39 are configured in the form of an exhaust throttle valve in which the first throttle valve 38 and the exhaust port 39 are integrated, and are disposed above the switching valve installation hole 46. As shown in FIG. 3B, the auxiliary flow path 32 is formed so as to extend upward from an upper part of the switching valve installation hole 46 toward the first throttle valve 38 and the exhaust port 39.

As shown in FIG. 3A, one end of the first portion 34*a* of the bypass flow path 34 opens in the head side port 14*a*, and the other end thereof extends toward the first side surface 45*c* side and communicates with the shuttle valve 42. Further, the second portion 34*b* of the bypass flow path 34 extends from the shuttle valve 42 toward the cylinder tube 12 and communicates with the head side pressure chamber 12*a*.

Figure 4A:
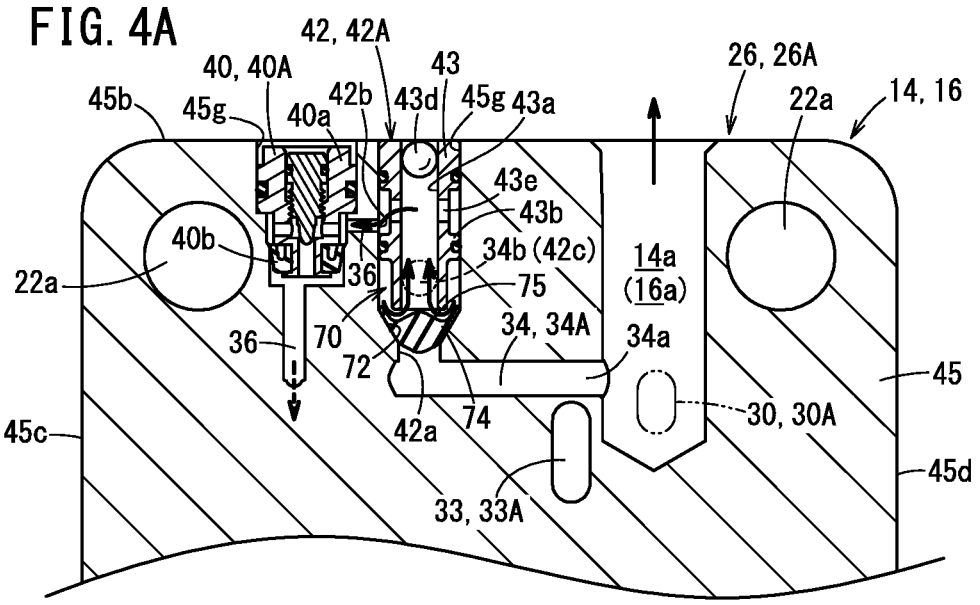
FIG. 4A is a cross-sectional view taken along line IVA-IVA of FIG. 3A.
Figure 4B:
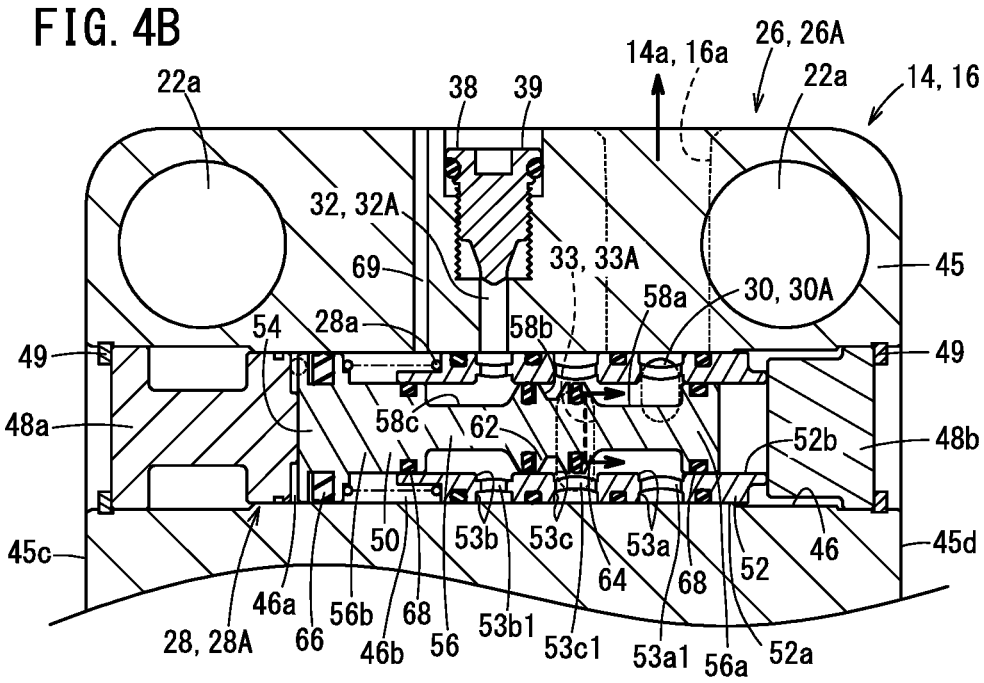
FIG. 4B is a cross-sectional view taken along line IVB-IVB of FIG. 3A.

As shown in FIG. 4A, the valve hole 45*g* in which the shuttle valve 42 is disposed includes a flow path member accommodating portion 70, which extends downward with a constant inner diameter, and an inclined portion 72 formed at a lower end of the flow path member accommodating portion 70. The inclined portion 72 is inclined in a manner so that the diameter thereof is reduced in a downward direction, and the first inlet 42*a* in which the first portion 34*a* of the bypass flow path 34 opens is formed at a lower end of the inclined portion 72. On a side part of the flow path member accommodating portion 70, the second portion 34*b* of the bypass flow path 34 opens in the form of the outlet 42*c*, and the pilot air flow path 36 opens in the form of the second inlet 42*b*. The second inlet 42*b* is disposed above the outlet 42*c*.

The shuttle valve 42 includes a flow path member 43 and a valve element 74 which are inserted into the flow path member accommodating portion 70. The flow path member 43 is a cylindrical member formed with a smaller diameter than that of the flow path member accommodating portion 70, and is equipped with a branching flow path 43*a* in the interior thereof. An upper end of the branching flow path 43*a* is sealed by a steel ball 43*d*, and a lower end of the branching flow path 43*a* opens in the flow path member accommodating portion 70 in the vicinity of the outlet 42*c*. A ventilation hole 43*e* that penetrates in a radial direction is formed in the vicinity of the second inlet 42*b* of the branching flow path 43*a*, and the branching flow path 43*a* and the second inlet 42*b* communicate with each other through the ventilation hole 43*e*. An upper end of the flow path member 43 is formed with an outer diameter that is substantially the same as the inner diameter of the flow path member accommodating portion 70, and the flow path member 43 is placed in close contact with the flow path member accommodating portion 70, and is fixed to the flow path member accommodating portion 70. Further, on an outer side part of the flow path member 43 between the second inlet 42*b* and the outlet 42*c*, a partition member 43*b* is provided so as to project outward in a radial direction, and is placed in close contact with the flow path member accommodating portion 70. A seal member made up from an O-ring or the like is provided on the partition member 43*b*, and airtightly separates the second inlet 42*b* and the outlet 42*c* on the outer side of the flow path member 43.

The valve element 74 is made up from an elastic member, is a substantially conical plate-shaped member that is convex downward, and is formed with a substantially V-shaped cross section. The outer diameter of the valve element 74 is formed to be smaller than the inner diameter of the flow path member accommodating portion 70, and is arranged so as to be capable of being displaced in a vertical direction in the interior of the flow path member accommodating portion 70. A lower side of the valve element 74 is constituted by an inclined surface that can be placed in close surface contact with the inclined portion 72. Further, a conically-shaped protruding part 75 is formed at an upper end central portion of the valve element 74. When the valve element 74 is displaced upward, the protruding part 75 is inserted into the branching flow path 43*a* and airtightly seals the branching flow path 43*a*.

Figure 5A:
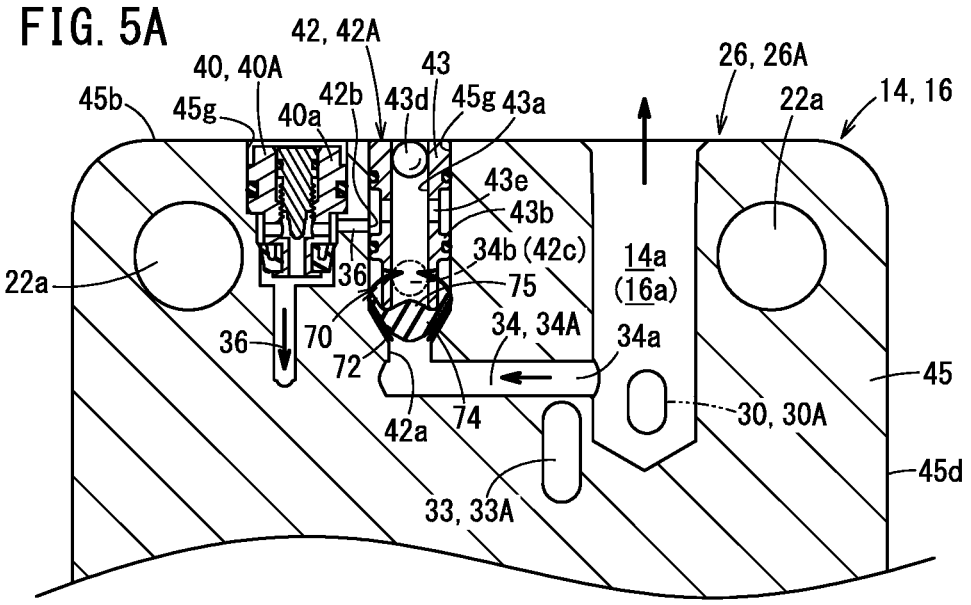
FIG. 5A is an explanatory diagram showing a flow of exhaust air in the cross section of FIG. 4A.

At the position shown in FIG. 4A, the lower side of the valve element 74 is in close contact with the inclined portion 72 to airtightly seal the first inlet 42*a* and the outlet 42*c*, and allows the second inlet 42*b* and the outlet 42*c* to communicate with each other. When the pressure on the first inlet 42*a* side becomes higher than the pressure on the outlet 42*c* side, the valve element 74 is displaced upward as shown in FIG. 5A. In this state, the valve element 74 closes the branching flow path 43*a*, thereby blocking communication between the second inlet 42*b* and the outlet 42*c*, and allowing the first inlet 42*a* and the outlet 42*c* to communicate with each other. More specifically, the valve element 74 allows the first portion 34*a* and the second portion 34*b* of the bypass flow path 34 to communicate with each other.

As shown in FIG. 4A, the pilot air adjustment part 40 is arranged adjacent to the first side surface 45*c* side of the shuttle valve 42. The pilot air adjustment part 40 is configured in the form of a check valve equipped throttle valve in which the second throttle valve 40*a* and the check valve 40*b* are integrated. The pilot air flow path 36 is formed between the shuttle valve 42 and the pilot air adjustment part 40, and between the pilot air adjustment part 40 and the switching valve installation hole 46.

As shown in FIG. 4B, an end part of the pilot air flow path 36 opens in the switching valve installation hole 46 in the vicinity of a first cap 48*a*. As shown in FIG. 3A, one end part of the cylinder flow path 33 opens in the switching valve installation hole 46 at a portion between the main flow path 30 and the auxiliary flow path 32 (see FIG. 4B). As shown in FIG. 3B, the cylinder flow path 33 extends from the switching valve installation hole 46 toward the cylinder tube 12, and the other end part of the cylinder flow path 33 opens in the head side pressure chamber 12*a*.

As shown in FIG. 4B, the switching valve 28 is configured in the form of a spool valve including a cylindrical spool guide member 52 provided in the switching valve installation hole 46, and a spool 50 that slides in the interior of the spool guide member 52. The switching valve installation hole 46 is formed as a through hole formed with a substantially constant diameter. An end part thereof on the first side surface 45*c* side is sealed by the first cap 48*a*, and an end part thereof on the second side surface 45*d* side is sealed by a second cap 48*b*. The caps 48*a* and 48*b* are fixed in the switching valve installation hole 46 by retaining clips 49. The spool guide member 52 is provided in the switching valve installation hole 46 between the caps 48*a* and 48*b*.

The spool guide member 52 includes an outer peripheral portion 52*a* placed in close contact with the switching valve installation hole 46, and an inner peripheral portion 52*b* through which the spool 50 is inserted. On the spool guide member 52, first to third communication grooves 53*a* to 53*c* are formed by cutting out the outer peripheral portion 52*a* and the inner peripheral portion 52*b* in groove-like shapes in the circumferential direction. The first communication groove 53*a* is formed on the second side surface 45*d* side and communicates with the main flow path 30. The second communication groove 53*b* is formed on the first side surface 45*c* side and communicates with the auxiliary flow path 32. The third communication groove 53*c* is formed between the first communication groove 53*a* and the second communication groove 53*b* and communicates with the cylinder flow path 33. The first to third communication grooves 53*a* to 53*c* are provided with ventilation openings 53*a*1, 53*b*1, and 53*c*1, respectively, at a plurality of locations in the circumferential direction, thereby enabling the outer peripheral portion 52*a* side and the inner peripheral portion 52*b* side to communicate with each other.

The spool 50 is equipped with the piston member 54 accommodated between the spool guide member 52 and the first cap 48*a*, and a spool member 56 inserted into the inner peripheral portion 52*b* of the spool guide member 52. The piston member 54 has a diameter larger than that of the spool member 56, and a packing 66 is mounted on the outer periphery thereof. The piston member 54 partitions the space between the spool guide member 52 and the first cap 48*a* into a vacant chamber 46*a* on the first cap 48*a* side, and a vacant chamber 46*b* on the spool guide member 52 side. The vacant chamber 46*a* communicates with the pilot air flow path 36. Further, the vacant chamber 46*b* communicates with an air vent hole 69. Furthermore, the return spring 28*a* which biases the piston member 54 toward the first cap 48*a* side is arranged in the vacant chamber 46*b*.

The spool member 56 is formed integrally with the piston member 54, and extends toward the spool guide member 52 side. The spool member 56 includes guide end parts 56*a* and 56*b* formed at both ends thereof in the axial direction. The guide end parts 56*a* and 56*b* are formed with an outer diameter that is slightly smaller than the inner diameter of the inner peripheral portion 52*b* of the spool guide member 52, and guide the movement of the spool 50 in the axial direction. Further, packings 68 are provided respectively on the guide end parts 56*a* and 56*b*, in order to prevent air from leaking along the axial direction. A first sealing wall 62 and a second sealing wall 64 are provided between the guide end parts 56*a* and 56*b*.

The first sealing wall 62 is formed with an outer diameter that is slightly smaller than that of the inner peripheral portion 52*b* of the spool guide member 52, and is equipped with the packing 68 on an outer peripheral portion thereof. At the first position shown in FIG. 4B, the first sealing wall 62 is placed at a position between the second communication groove 53*b* and the third communication groove 53*c* to block communication therebetween.

The second sealing wall 64 is formed with an outer diameter that is equivalent to that of the first sealing wall 62, and is equipped with the packing 68 on an outer peripheral portion thereof. At the second position shown in FIG. 6B, the second sealing wall 64 is placed at a position between the first communication groove 53*a* and the third communication groove 53*c* to block communication therebetween.

Further, recesses 58*a*, 58*b*, and 58*c*, which are cut out in groove-like shapes over the entire area in the circumferential direction, are formed in the spool member 56. The recess 58*a* is formed between the guide end part 56*a* and the second sealing wall 64, the recess 58*b* is formed between the first sealing wall 62 and the second sealing wall 64, and the recess 58*c* is formed between the first sealing wall 62 and the guide end part 56*b*. The recesses 58*a*, 58*b*, and 58*c*, by forming an air flow path having a large cross-sectional area between the spool member 56 and the spool guide member 52, facilitate the passage of the high pressure air or the exhaust air.

The head cover 14 is configured in the manner described above. Further, as shown in FIG. 1A, since the rod cover 16 is formed with substantially the same structure as that of the head cover 14 except that it includes an insertion hole 47 through which the piston rod 20 is inserted, the same constituent elements as those of the head cover 14 are designated by the same reference numerals, and detailed description of thereof is omitted. However, with respect to the main flow path 30, the auxiliary flow path 32, the cylinder flow path 33, the bypass flow path 34, the switching valve 28, the pilot air adjustment part 40, and the shuttle valve 42 of the rod side flow rate controller 26A, the letter A has been appended to each of such reference numerals in order to distinguish them.

The air cylinder 10 according to the present embodiment is configured in the manner described above. Hereinafter, a description will be given concerning actions of the air cylinder 10 together with operations thereof.

As shown in FIG. 5A, in the operating stroke, high pressure air is introduced from the head side port 14*a*. The high pressure air is introduced into the main flow path 30 and the bypass flow path 34. In the shuttle valve 42, the valve element 74 is displaced upward by the high pressure air, the first inlet 42*a* and the outlet 42*c* are allowed to communicate with each other, and the first portion 34*a* and the second portion 34*b* of the bypass flow path 34 are allowed to communicate with each other. In accordance therewith, the high pressure air flows through the bypass flow path 34 into the head side pressure chamber 12*a* (see FIG. 3B).

Figure 5B:
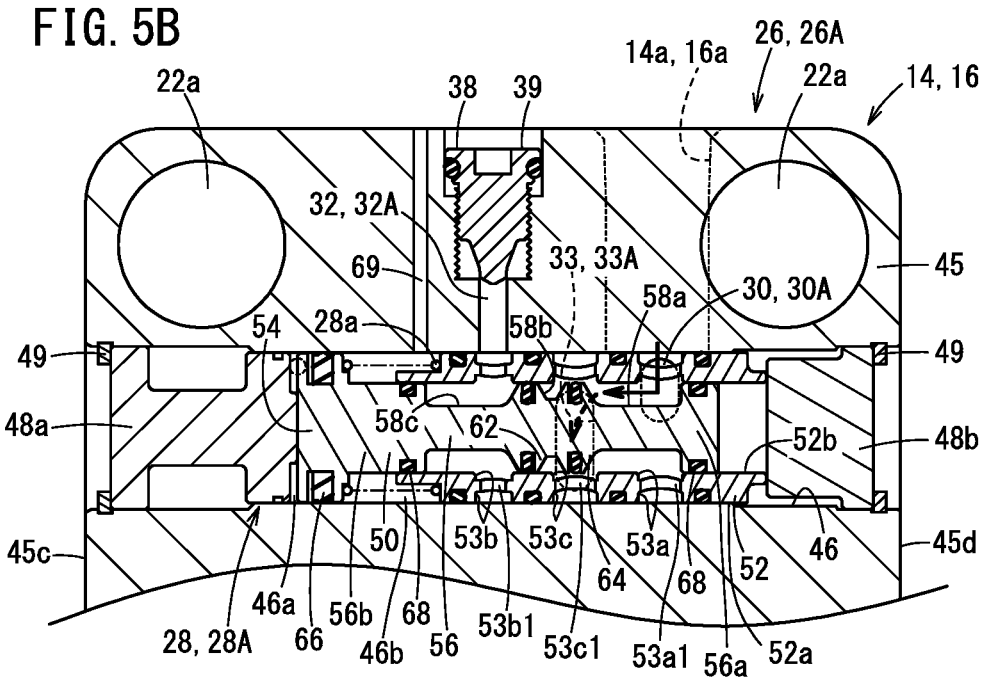
FIG. 5B is a cross-sectional view showing a flow of exhaust air in the cross section of FIG. 4B.

Further, the high pressure air introduced into the main flow path 30 flows into the first communication groove 53*a* of the spool guide member 52 via the third throttle valve 44 (see FIG. 3B). The spool 50 of the switching valve 28 is in the first position shown in FIG. 5B, and the high pressure air, which has flowed into the switching valve 28 from the main flow path 30, flows into the third communication groove 53*c* through the recess 58*a*, and flows into the head side pressure chamber 12*a* through the cylinder flow path 33 (see FIG. 3B). In this manner, in the operating stroke, the high pressure air is introduced via the main flow path 30 and the bypass flow path 34 in the head cover 14. Since the bypass flow path 34 bypasses the third throttle valve 44, the high pressure air is introduced in a free flowing manner into the head side pressure chamber 12*a* (see FIG. 3B).

On the other hand, in the rod cover 16, in the operating stroke, as shown in FIG. 2, the exhaust air that is discharged from the rod side pressure chamber 12*b* flows into a cylinder flow path 33A and the second portion 34*b* of a bypass flow path 34A. The exhaust air that has flowed from the second portion 34*b* into a shuttle valve 42A displaces the valve element 74 downward, as shown in FIG. 4A. In accordance therewith, communication between the first portion 34*a* and the second portion 34*b* of the bypass flow path 34A is blocked. Further, a portion of the exhaust air passes through the second inlet 42*b* of the shuttle valve 42A and the pilot air flow path 36 and flows into a pilot air adjustment part 40A. Then, the exhaust air, which is throttled to a predetermined flow rate by the pilot air adjustment part 40A, flows as pilot air into the vacant chamber 46*a* which is adjacent to the piston member 54.

In a rod side switching valve 28A, since the spool 50 is biased by the return spring 28*a* and is placed in the first position, the exhaust air, which has flowed from the cylinder flow path 33 into the switching valve 28A, flows into a main flow path 30A via the third communication groove 53*c*, the recess 58*a*, and the first communication groove 53*a*. While the flow rate is being regulated by the third throttle valve 44 of the main flow path 30A, the exhaust air is discharged from the rod side port 16*a*. In this manner, the flow rate controller 26A constitutes a meter-out speed controller, which regulates the operating speed of the piston 18 by the exhaust air from the air cylinder 10.

Figure 6A:
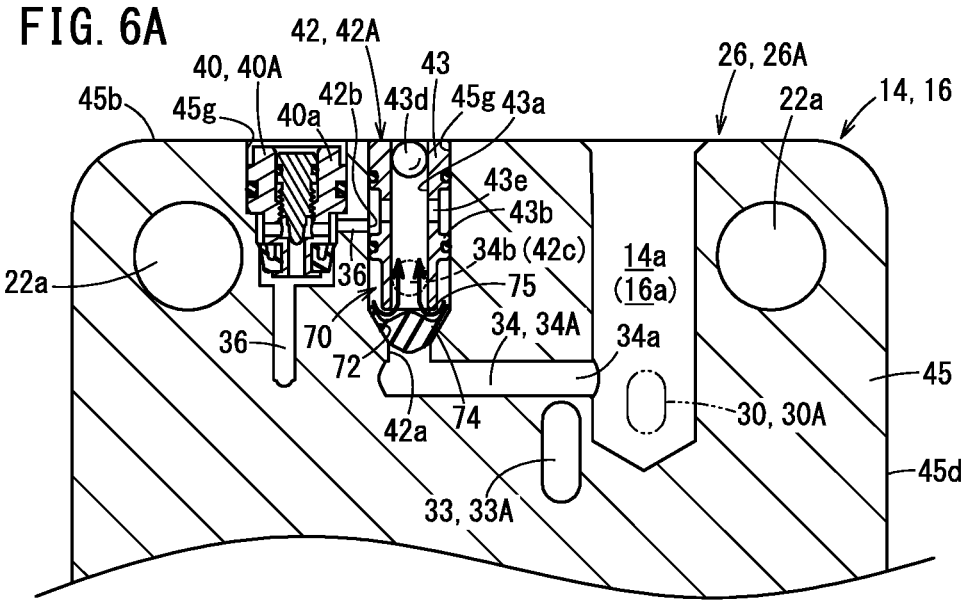
FIG. 6A is an explanatory diagram showing a flow of exhaust air in the cross section of FIG. 4A.
Figure 6B:
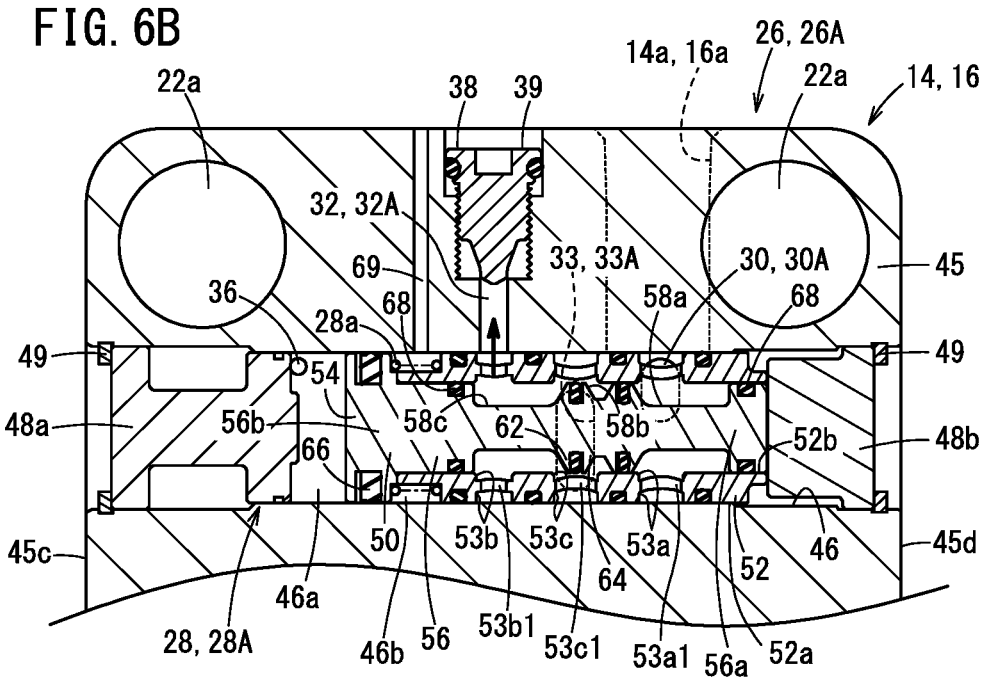
FIG. 6B is an explanatory diagram showing a flow of exhaust air after having passed through the first throttle valve of an auxiliary flow path in the cross section of FIG. 4B.

In the rod cover 16, the pilot air flows as shown in FIG. 6A, and accompanying movement of the piston 18, the pressure of the pilot air in the vacant chamber 46*a* gradually increases. Then, when the pressure of the pilot air exceeds a predetermined value, the piston member 54 is displaced to the second position against the elastic force of the return spring 28*a* as shown in FIG. 6B. When the spool 50 is displaced to the second position, communication between the first communication groove 53*a* and the third communication groove 53*c* is blocked, and the third communication groove 53*c* and the second communication groove 53*b* are allowed to communicate with each other. More specifically, the cylinder flow path 33A and an auxiliary flow path 32A communicate with each other. The exhaust air passes through the recess 58*c* and flows into the auxiliary flow path 32A, and while the flow rate thereof is regulated by the first throttle valve 38, the exhaust air is discharged from the exhaust port 39. Since the exhaust air is throttled more strongly by the first throttle valve 38, the operating speed of the piston 18 is decreased. By appropriately adjusting the amount of throttling of the pilot air adjustment part 40, the spool 50 is switched from the first position to the second position in the vicinity of the stroke end of the piston 18, and the impact of the piston 18 at the stroke end is mitigated.

Thereafter, when the piston 18 is stopped, inflowing of the exhaust air is stopped, and the pilot air of the switching valve 28A is discharged through the check valve 40*b* of the pilot air adjustment part 40A. Then, the spool 50 of the switching valve 28A is returned to the first position by the elastic force of the return spring 28*a*.

In accordance with the foregoing, the action of the operating stroke of the air cylinder 10 comes to an end. By the operation switching valve 80 being switched from the first position to the second position, the return stroke is initiated. In the return stroke, the exhaust air flows into the head side flow rate controller 26, and the high pressure air is introduced through the rod side flow rate controller 26A. The operations of the air cylinder 10 in the return stroke simply involve a switching of places in the operating stroke between the head side flow rate controller 26 and the rod side flow rate controller 26A, and since the operations in the return stroke and the operations in the operating stroke are substantially the same, a description of such operations will be omitted.

The air cylinder 10, the head cover 14, and the rod cover 16 of the present embodiment realize the following advantageous effects.

The air cylinder 10 according to the present embodiment comprises the cylinder tube 12 in which the cylinder chamber 12*c* is formed, the head cover 14 that closes one end of the cylinder tube 12, the rod cover 16 that closes the other end of the cylinder tube 12, the piston 18 that slides inside the cylinder tube 12, the piston rod 20 having one end connected to the piston 18, the port 14*a*, 16*a* provided in each of the head cover 14 and the rod cover 16, and the flow rate controller 26 incorporated in at least one of the head cover 14 or the rod cover 16, wherein the flow rate controller 26 includes the main flow path 30 communicating with the port 14*a*, 16*a*, the auxiliary flow path 32 disposed in parallel with the main flow path 30, and including the first throttle valve 38 which throttles the flow rate of the air to a flow rate less than that in the main flow path 30, the cylinder flow path 33 communicating with the cylinder chamber 12*c*, the switching valve 28 connected to the main flow path 30, the auxiliary flow path 32, and the cylinder flow path 33, and switched between the first position in which the cylinder flow path 33 is allowed to communicate with the main flow path 30, and the second position in which the cylinder flow path 33 is allowed to communicate with the auxiliary flow path 32, and the pilot air adjustment part 40 which guides a portion of the exhaust air in the cylinder flow path 33 to the switching valve 28 as pilot air, and wherein the pilot air adjustment part 40 includes the second throttle valve 40*a* that regulates the inflowing speed at which the pilot air flows into the switching valve 28, and the switching valve 28 is switched from the first position to the second position due to a rise in the pressure of the pilot air.

In the flow rate controller 26 according to the present embodiment, a portion of the exhaust air is used as pilot air. The pilot air adjustment part 40 functions as a meter-in speed controller that regulates the flow rate of the pilot air flowing into the switching valve 28. Since a sufficient pressure always acts continuously on the second throttle valve 40*a* of the pilot air adjustment part 40 accompanying movement of the piston 18, the pilot air passing through the second throttle valve 40*a* can be prevented from decreasing, and the timing at which the switching valve 28 is operated can be stabilized.

In the above-described air cylinder 10, the flow rate controller 26 may further include the bypass flow path 34 that bypasses the switching valve 28 and allows the port 14*a*, 16*a* and the cylinder chamber 12*c* to communicate with each other, and the shuttle valve 42 including the first inlet 42*a*, the second inlet 42*b*, and the outlet 42*c*, wherein the first portion 34*a* of the bypass flow path 34 that communicates with the port 14*a*, 16*a* is connected to the first inlet 42*a*, the second portion 34*b* of the bypass flow path 34 that communicates with the cylinder chamber 12*c* is connected to the outlet 42*c*, and the pilot air adjustment part 40 is connected to the second inlet 42*b*, and when the pressure in the port 14*a*, 16*a* becomes higher than the pressure in the cylinder chamber 12*c*, the shuttle valve 42 closes the second inlet 42*b* and allows the first inlet 42*a* and the outlet 42*c* to communicate with each other, and when the pressure in the cylinder chamber 12*c* becomes higher than the pressure in the port 14*a*, 16*a*, the shuttle valve 42 closes the first inlet 42*a* and allows the second inlet 42*b* and the outlet 42*c* to communicate with each other. In accordance with such a configuration, the bypass flow path 34 functions as an exhaust flow path that guides the exhaust air to the pilot air adjustment part 40, together with serving as an introduction flow path for the high pressure air. In accordance therewith, it is possible to realize both stabilization of the switching operation of the flow rate controller 26, and improvement of the operating speed of the air cylinder 10.

In the above-described air cylinder 10, the switching valve 28 may include the switching valve installation hole 46 formed in the main body portion 45 of the head cover 14 or the rod cover 16, the spool guide member 52 arranged along the inner peripheral surface of the switching valve installation hole 46, the spool 50 inserted through the inner peripheral portion 52*b* of the spool guide member 52, and the return spring 28*a* installed inside the switching valve installation hole 46 and biasing the spool 50 toward the first position, and the spool 50 may include the spool member 56 that slides on the inner peripheral portion 52*b* of the spool guide member 52 and thereby switches the connection destination of the flow paths, and the piston member 54 that is biased toward the second position by receiving the pressure of the pilot air. In accordance with such a configuration, the flow rate controller 26 including the switching valve 28 can be incorporated in a compact manner in the interior of the main body portion 45 of the head cover 14 or the rod cover 16.

In the above-described air cylinder 10, the main flow path 30 may include the third throttle valve 44, and the bypass flow path 34 may bypass the switching valve 28 and the third throttle valve 44 and connect the port 14*a*, 16*a* and the cylinder chamber 12*c*. In accordance with such a configuration, because the high pressure air flows into the cylinder chamber 12*c* through the bypass flow path 34 that bypasses the third throttle valve 44, the operating speed of the air cylinder 10 can be improved.

In the above-described air cylinder 10, the switching valve installation hole 46 may be formed so as to extend in a direction orthogonal to the axial direction of the cylinder tube 12. In accordance therewith, the axial dimension of the cylinder tube 12 of the air cylinder 10 can be reduced.

The head cover 14 according to the present embodiment is the head cover 14 for the air cylinder 10 that covers the head side end part of the cylinder tube 12, and comprises the port 14*a*, the main flow path 30 communicating with the port 14*a*, the auxiliary flow path 32 disposed in parallel with the main flow path 30, and including the first throttle valve 38 which throttles the flow rate of the air to a flow rate less than that in the main flow path 30, the cylinder flow path 33 communicating with the cylinder chamber 12*c*, the switching valve 28 connected to the main flow path 30, the auxiliary flow path 32, and the cylinder flow path 33, and switched between the first position in which the cylinder flow path 33 and the main flow path 30 are allowed to communicate with each other, and the second position in which the cylinder flow path 33 and the auxiliary flow path 32 are allowed to communicate with each other, and the pilot air adjustment part 40 that guides the exhaust air in the cylinder chamber 12*c* to the switching valve 28 as pilot air, wherein the pilot air adjustment part 40 includes the second throttle valve 40*a* that regulates the inflowing speed at which the pilot air flows into the switching valve 28, and the switching valve 28 is switched from the first position to the second position due to a rise in the pressure of the pilot air.

In accordance with the above-described head cover 14, the timing at which the switching operation of the switching valve 28 occurs can be stabilized, together with simplifying the device configuration of the drive device 76 of the air cylinder 10.

The rod cover 16 according to the present embodiment is the rod cover 16 for the air cylinder 10 that covers the rod side end part of the cylinder tube 12, and comprises the insertion hole 47 through which the piston rod 20 is inserted, the port 16*a*, the main flow path 30A communicating with the port 16*a*, the auxiliary flow path 32A disposed in parallel with the main flow path 30A, and including the first throttle valve 38 which throttles the flow rate of the air to a flow rate less than that in the main flow path 30A, the cylinder flow path 33A communicating with a cylinder chamber 12*c*, the switching valve 28A connected to the main flow path 30A, the auxiliary flow path 32A, and the cylinder flow path 33A, and switched between the first position in which the cylinder flow path 33A and the main flow path 30A are allowed to communicate with each other, and the second position in which the cylinder flow path 33A and the auxiliary flow path 32A are allowed to communicate with each other, and the pilot air adjustment part 40A that guides the exhaust air in the cylinder chamber 12*c* to the switching valve 28A as pilot air, wherein the pilot air adjustment part 40A includes the second throttle valve 40*a* that regulates the inflowing speed at which the pilot air flows into the switching valve 28A, and the switching valve 28A is switched from the first position to the second position due to a rise in the pressure of the pilot air.

In accordance with the above-described rod cover 16, the timing at which the switching operation of the switching valve 28A occurs can be stabilized, together with simplifying the device configuration of the drive device 76 of the air cylinder 10.

Although a description of a preferred embodiment of the present invention has been presented above, it should be understood that the present invention is not limited to the above-described embodiment, but various changes and modifications may be made within a range that does not deviate from the essence and gist of the present invention.

The invention claimed is:

1. An air cylinder comprising:

a cylinder tube in which a cylinder chamber is formed;

a head cover configured to close one end of the cylinder tube;

a rod cover configured to close another end of the cylinder tube;

a piston configured to slide in the cylinder chamber;

a piston rod having one end connected to the piston;

a port provided in each of the head cover and the rod cover; and a flow rate controller incorporated in at least one of the head cover or the rod cover, wherein the flow rate controller includes:

a main flow path communicating with the port;

an auxiliary flow path disposed in parallel with the main flow path, and including a first throttle valve configured to throttle a flow rate of air to a flow rate less than that in the main flow path;

a cylinder flow path communicating with the cylinder chamber;

a switching valve connected to the main flow path, the auxiliary flow path, and the cylinder flow path, and configured to be switched between a first position in which the cylinder flow path is allowed to communicate with the main flow path, and a second position in which the cylinder flow path is allowed to communicate with the auxiliary flow path; and a pilot air adjustment part configured to guide a portion of exhaust air in the cylinder flow path to the switching valve as pilot air, and wherein the pilot air adjustment part includes a second throttle valve configured to regulate an inflowing speed at which the pilot air flows into the switching valve, and the switching valve is switched from the first position to the second position due to a rise in a pressure of the pilot air.

2. The air cylinder according to claim 1, wherein the flow rate controller further includes:

a shuttle valve including a first inlet, a second inlet, and an outlet, wherein the port is connected to the first inlet, the cylinder chamber is connected to the outlet, and the pilot air adjustment part is connected to the second inlet, and when a pressure in the port becomes higher than a pressure in the cylinder chamber, the shuttle valve closes the second inlet and allows the first inlet and the outlet to communicate with each other, and when the pressure in the cylinder chamber becomes higher than the pressure in the port, the shuttle valve closes the first inlet and allows the second inlet and the outlet to communicate with each other.

3. The air cylinder according to claim 2, wherein the main flow path includes a third throttle valve.

4. The air cylinder according to claim 3, wherein the switching valve includes a switching valve installation hole formed in a main body portion of the head cover or the rod cover, a spool guide member arranged along an inner peripheral surface of the switching valve installation hole, a spool inserted through an inner peripheral portion of the spool guide member, and a return spring installed inside the switching valve installation hole and configured to bias the spool toward the first position, and the spool includes a spool member configured to slide on the inner peripheral portion of the spool guide member and thereby switch a flow path connection destination, and a piston member configured to be biased toward the second position by receiving the pressure of the pilot air.

5. The air cylinder according to claim 4, wherein the switching valve installation hole is formed so as to extend in a direction orthogonal to an axial direction of the cylinder tube.

6. A head cover for an air cylinder that covers a head side end part of a cylinder tube, the head cover comprising:

a port;

a main flow path communicating with the port;

an auxiliary flow path disposed in parallel with the main flow path, and including a first throttle valve configured to throttle a flow rate of air to a flow rate less than that in the main flow path;

a cylinder flow path communicating with a cylinder chamber of the cylinder tube;

a switching valve connected to the main flow path, the auxiliary flow path, and the cylinder flow path, and configured to be switched between a first position in which the cylinder flow path and the main flow path are allowed to communicate with each other, and a second position in which the cylinder flow path and the auxiliary flow path are allowed to communicate with each other; and a pilot air adjustment part configured to guide exhaust air in the cylinder chamber to the switching valve as pilot air, wherein the pilot air adjustment part includes a second throttle valve configured to regulate an inflowing speed at which the pilot air flows into the switching valve, and the switching valve is switched from the first position to the second position due to a rise in a pressure of the pilot air.

7. A rod cover for an air cylinder that covers a rod side end part of a cylinder tube, the rod cover comprising:

an insertion hole through which a piston rod is inserted;

a port;

a main flow path communicating with the port;

an auxiliary flow path disposed in parallel with the main flow path, and including a first throttle valve configured to throttle a flow rate of air to a flow rate less than that in the main flow path;

a cylinder flow path communicating with a cylinder chamber of the cylinder tube;

a switching valve connected to the main flow path, the auxiliary flow path, and the cylinder flow path, and configured to be switched between a first position in which the cylinder flow path and the main flow path are allowed to communicate with each other, and a second position in which the cylinder flow path and the auxiliary flow path are allowed to communicate with each other; and a pilot air adjustment part configured to guide exhaust air in the cylinder chamber to the switching valve as pilot air, wherein the pilot air adjustment part includes a second throttle valve configured to regulate an inflowing speed at which the pilot air flows into the switching valve, and the switching valve is switched from the first position to the second position due to a rise in a pressure of the pilot air.

* * * * *